United States Patent [19]

Helldorfer

[11] 4,246,952

[45] Jan. 27, 1981

[54] INTERIOR TYPE WEATHER SEAL PANEL

[76] Inventor: Lillian S. Helldorfer, 2219 Wicomico Rd., Baltimore, Md. 21221

[21] Appl. No.: 948,661

[22] Filed: Oct. 5, 1978

[51] Int. Cl.[3] ..... E06B 9/17

[52] U.S. Cl. ..... 160/271

[58] Field of Search ..... 160/266–273 R

[56] References Cited

U.S. PATENT DOCUMENTS

| | | | |
|---|---|---|---|
| 1,672,648 | 6/1928 | Lenish | 160/271 |
| 1,882,951 | 10/1932 | Rupprecht | 160/273 R |
| 2,009,917 | 7/1935 | Flanagan | 160/271 |
| 2,501,454 | 3/1950 | Schueren | 160/273 R |
| 2,521,455 | 9/1950 | Gorgun | 160/273 R |
| 2,856,995 | 10/1958 | Roth | 160/267 |
| 3,051,232 | 8/1962 | Lamb | 160/273 R |
| 4,126,174 | 11/1978 | Moriarity et al. | 160/271 |

FOREIGN PATENT DOCUMENTS

| | | | |
|---|---|---|---|
| 1020785 | 2/1966 | United Kingdom | 160/273 R |

*Primary Examiner*—Peter M. Caun

*Attorney, Agent, or Firm*—John F. McClellan, Sr.

[57] ABSTRACT

An interior-use weather seal panel assembly which is easily installed at almost any window or door and openable for access through it includes a flexible transparent plastic sheet supported by a roller at one end, tracks on the sides and a lockable, detachable sealing member at the bottom; direct air-passage with the unit closed is substantially eliminated, by the sealing structure.

Because of the support and locking feature, the unit can be installed at any orientation desired; when the unit is fully open, none of the plastic sheet is exposed, so that the unit can be safely stored in place in the sun indefinitely if desired. The sealing member at the bottom has a reservoir to contain condensation sliding down the plastic sheet, and when the sealing member at the bottom is removed for cleaning, the plastic sheet and roller can be removed at the top for cleaning. The sides are substantially self-cleaning when vertical.

3 Claims, 6 Drawing Figures

FIG. 1
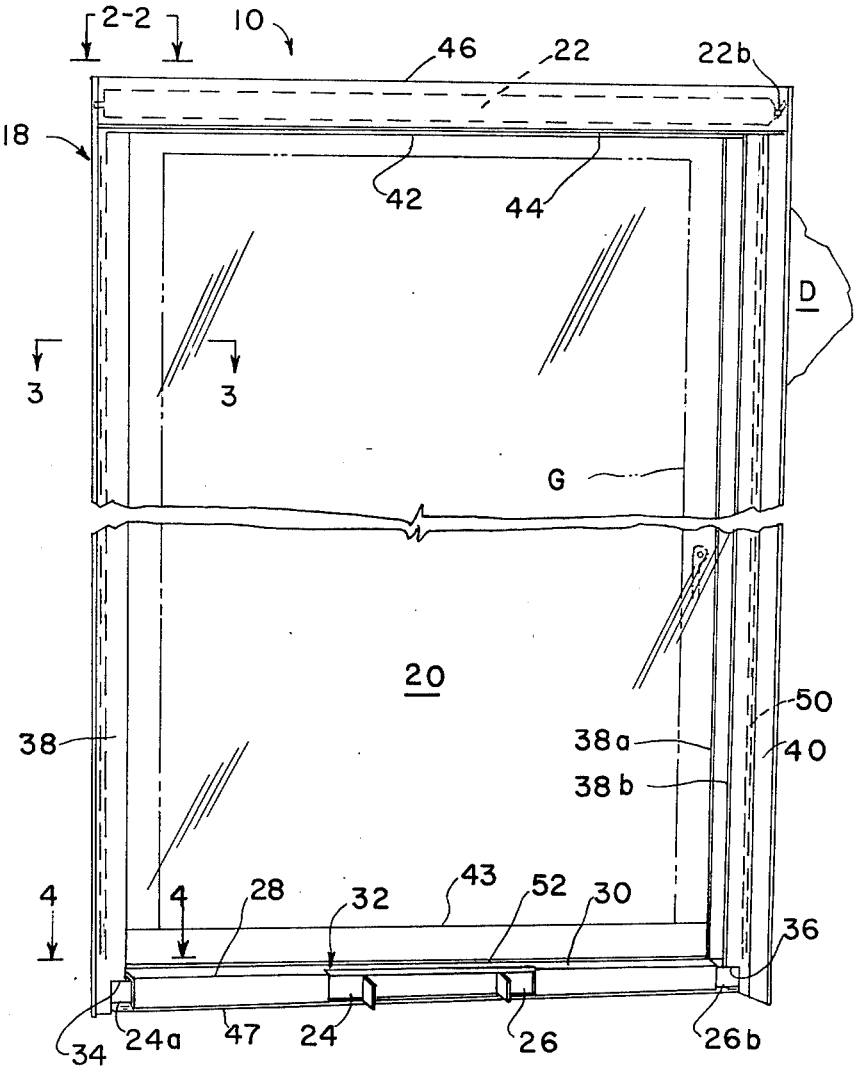
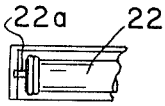
FIG. 2
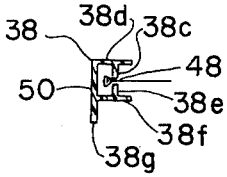
FIG. 3
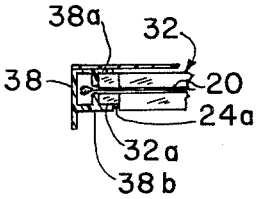
FIG. 4
FIG. 5
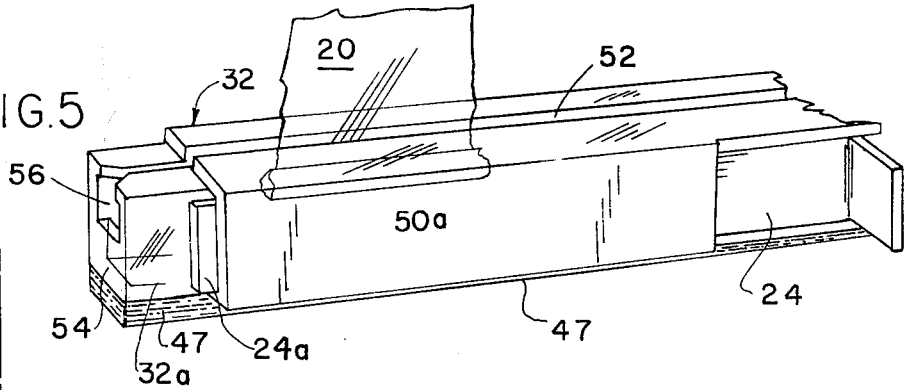
FIG. 6
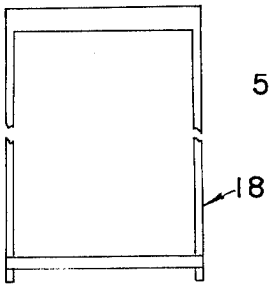

INTERIOR TYPE WEATHER SEAL PANEL

This invention relates generally to weather sealing and particularly to an interior type weather seal panel usable in addition to regular windows and doors.

A principal object of this invention is to provide an openable/closable, universal-fit type weather seal panel assembly which will prove the standard article of commerce for the purpose.

In the prior art numerous disclosures have been made which relate to weather seal devices including those of the following U.S. Patents:

No. 2,856,995 to L. Roth, Oct. 21, 1958, discloses a roll-type protective closure applicable to dwelling windows;

No. 3,115,182 to E. F. Bobbitt, Dec. 24, 1963, discloses a roll-type closure with flexible channel-seal;

No. 3,386,490 to J. B. Denton et al discloses another form of roll-type closure and refers to the tension type as represented by a patent from the last century;

No. 2,474,747 to E. Madriguera, June 28, 1949 discloses combination roll-up screen and storm window.

However the advantages of this invention, including those set forth in the objects, are believed not fairly suggested by the above or any other known prior art.

A further object is to provide a weather seal panel assembly which is size adaptable through simple fabrication changes in length of straight parts to provide an economical, light weight unit draft-proofer for almost any door or window.

Further objects are to provide a unit as described which can catch condensation, instead of permitting it to stain window sills, which raises clear of sills for sill cleaning, which is self-supportive which can be applied to windows or doors through which access or ventilation is required at times without removal of the unit, which is easy to secure and remove and to clean, which is substantially self-protective when open, which efficiently transmits light, which locks, which, if desired, can be installed in any orientation, and which is equally efficient at keeping cooled air inside and excluding warm air in summer or at keeping warm air inside and excluding cold air in winter.

In brief summary given for cursive descriptive purpose only and not as limitation, the invention includes a frame with roller mounted flexible panel supported on all sides in draft-proofing channels and with provision for condensate collection at the bottom.

The above and other objects and advantages will become more readily apparent on examination of the following description, including the drawings, in which like reference numerals refer to like parts:

FIG. 1 is perspective view of the invention installed on a sliding patio door which is indicated in phantom lines;

FIG. 2 is a plan detail taken at 2—2, FIG. 1;

FIG. 3 is a sectional plan detail taken at 3—3, FIG. 1;

FIG. 4 is a partially sectional plan detail adapted from 4—4, FIG. 1;

FIG. 5 is a perspective detail of the bottom member shown in FIG. 1; and FIG. 6 is a rear elevational view on a reduced scale of the FIG. 1 showing.

FIG. 1 shows the invention 10 in use covering the interior of a sliding panel glass door G (phantom lines) in a dwelling D, although in proper size it can as well cover a window. Access through the door is provided by the following features.

Frame 18 holds transparent flexible panel 20 which may be of "Mylar" or other appropriate sheeting and rolls up on conventional spring-return window shade roller 22. For this, angled-strap locks 24, 26 can be slid in keeps 28, 30, on the elongate bottom member 32, toward the center, releasing the lock ends 24*a*, 26*b* from respective notches 34, 36 in side pieces 38, 40 of the frame, permitting the panel to draw the bottom member, which is attached to it, upward.

The ends of the bottom member guide between parts of the respective side pieces in paired vertical guides or flanges 38*a*, 38*b* which extend inward as draft deflectors on each side, and the bottom member comes to rest against the top 42 of the frame, through which the panel emerges at slot 44, with none of the panel exposed to sunlight when not in use. Removable angle-piece 46 covers the roller top and near side, the frame covers the back and the bottom.

A transverse bottom brace 43 may be fixed across the sides parallel with the bottom member but at a slight height leaving a space for drainage and flexible fit between it an a window sill. Resilient sealing strip 47 is fixed to the bottom of 32.

FIG. 2 shows a plan view detail of the roller 22 exposed by removal of the cover. The ends 22*a*, 22*b* engage appropriate conventional slots in the frame to provide windup and guidance positioning; 22*b* appears in the first Figure.

FIG. 3 shows that the side pieces (38 shown, 40 is similar) are tubular in cross section and have full length vertical slots 48 through which the edges of the panel pass and are retained by cloth or plastic edge-beading 50, affixed to the panel edges as binding by sewing or by plastic welding.

The sectional shape of the side pieces is that of a capital "F" with a spur 38*c* midway of the upper arm 38*d* reaching down toward a similar spur 38*e* rising midway the lower arm, defining between them the slot 48. The extensions of the arm free ends beyond the spurs define the guides for the bottom member and act as draft shields or deflectors. A draft, to get through, must pass the upper arm slot between the spur and the tight "V" fit of the triangular section beading, and then around the beading, back past the other side of it and slot and out past the lower arm, or vice versa.

Leg 38*g* of the side piece sectional shape stiffens the frame and provides for mastic sealing on installation, or the like.

FIGS. 4 and 5 show respectively the relation of the bottom member 32 to the side pieces 38 (40 is similar) and further features of the bottom member. The ends 32*a* (32*b* not shown but similar) of the bottom member are of rectangular cross section like the rest, but are reduced in size, preferably, and fit between the guides 38*a*, 38*b*. The locks 24 (26 first Figure) and lower edges of side pieces defining the notches are slightly lower than the top of the reduced-section portions, so that the guides still retain the bottom member when it is locked and is forcing resilient strip 47 beneath the bottom member and affixed to it partially to compress and to seal completely against a window sill.

The longitudinal slot 52 in the top of the bottom member 32 is wide enough to pass moisture of condensation from the panel 20 into the hollow tubular interior of the bottom member, through cloth beading 50*a* where it can collect, held by end stops 54 from spilling on the window sill, and from which it can later be emptied by removal of the bottom member and pouring out at the spaces 56 over the ends stops. Removal of the bottom member also permits withdrawal upwardly of the panel for replacing or repairing the panel 20 with ease, if damaged.

Removal of the bottom member is simple and easy and quick. The locks are drawn to the center, the bottom member is forced down from the normal locking position further compressing the resilient strip, until the bottom member clears the lower-end of the inner guides and can be withdrawn straight outward of the plane of the frame toward the user. Then the panel is slid to the side, releasing the beading through the spaces at the tops of the stops; any condensation collected can be poured out of the interior. Replacement is the reverse of removal; a tapered end of the slot-defining structure aids insertion. Slacking the panel is easily accomplished at any time by forcing down the bottom member or removing it, there being enough panel length provided, according to this invention, for the purpose.

Because the bottom is removable the bottom slot can receive and pass the edge beading of the sides, permitting continuous beading to be used all around. The bottom beading 50*a* is larger than the edge beading to hold in the larger slot, but smaller than slot 44, for removal.

Material for the frame can be any suitable rigid plastic such as polystyrene or methyl methacrylate, and preferably transparent to pass maximum light. The bottom member may in any case advantageously be transparent, at least in part, permitting condensate level to be checked.

FIG. 6 shows that the back face of the frame 18 is preferably substantially flat, as well as the outer edges, and shows the space below the brace.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a weather seal unit of the type having a frame with a roller at the top holding a transparent flexible panel retractably in the frame, and an elongate bottom member supporting the free end of said panel, the improvement comprising: removable structure enclosing the roller, the panel passing downwardly from the roller through a slot in said enclosure, the frame having slotted tubular sides, the panel having beading along each lateral edge supportively retaining the panel lateral edges within respective slotted tubular sides, the bottom member being tubular and having a slot longitudinally in the top thereof and the panel having a beading detachably retaining the bottom end thereof in said longitudinal slot, the bottom member longitudinal slot being sufficiently wide for condensation to flow along the panel through said longitudinal slot into the bottom member, and closed end portions of the bottom member to retain condensate therein.

2. In a weather seal unit as recited in claim 1, the bottom member having a space above each of said end portions closed for pouring condensate out of the bottom member.

3. In a weather seal unit as recited in claim 2, the bottom member having a transparent area for observing condensate level.

* * * * *